US006888433B2

(12) United States Patent
Hamaguchi et al.

(10) Patent No.: US 6,888,433 B2
(45) Date of Patent: May 3, 2005

(54) METHOD FOR PRODUCING REPULSION MAGNETIC CIRCUIT AND ITS PRODUCTION SYSTEM

(75) Inventors: Ryoi Hamaguchi, Mie (JP); Hiroshi Wada, Osakasayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/493,240

(22) PCT Filed: Jun. 5, 2003

(86) PCT No.: PCT/JP03/07114

§ 371 (c)(1),
(2), (4) Date: Apr. 21, 2004

(87) PCT Pub. No.: WO03/105526

PCT Pub. Date: Dec. 18, 2003

(65) Prior Publication Data

US 2005/0005430 A1 Jan. 13, 2005

(30) Foreign Application Priority Data

Jun. 7, 2002 (JP) ..... 2002-167203

(51) Int. Cl.[7] ..... H01F 7/20; H04R 31/00; B25B 1/00

(52) U.S. Cl. ..... 335/285; 29/594; 29/607; 29/609.1; 269/86; 269/216; 269/240

(58) Field of Search ..... 269/8, 86, 216, 269/240–253; 29/602.1, 607, 609.1; 381/396, 412, 420, 421, 422; 335/284, 285

(56) References Cited

U.S. PATENT DOCUMENTS 5,701,657 A * 12/1997 Sakamoto ..... 29/594

FOREIGN PATENT DOCUMENTS

| | | |
|---|---|---|
| JP | 55-97798 | 7/1980 |
| JP | 59-104899 | 6/1984 |
| JP | 7-23498 | 1/1995 |
| JP | 7-264694 | 10/1995 |
| JP | 2000-334358 | 12/2000 |
| JP | 2001-274019 | 10/2001 |

* cited by examiner

*Primary Examiner*—Ramon M. Barrera
(74) *Attorney, Agent, or Firm*—Wenderoth, Lind & Ponack, L.L.P.

(57) ABSTRACT

The present invention provides a method of manufacture capable of manufacturing a repulsion magnetic circuit for a speaker with good production efficiency and in a stabilized manner and an apparatus for use in the manufacture. A position of abutment between first magnetic block circuit attached to lower jig (102) and second magnetic circuit block attached to upper jig (105) is detected by detection of a load current of servomotor (103). A pressing time for achieving adhesion is established by the number of pulses from encoder directly coupled with servomotor (103).

6 Claims, 3 Drawing Sheets

METHOD FOR PRODUCING REPULSION MAGNETIC CIRCUIT AND ITS PRODUCTION SYSTEM

TECHNICAL FIELD

The present invention relates to a method of manufacturing a repulsion magnetic circuit of a speaker used in a variety of audiovisual equipment and an apparatus for use in the manufacturing method.

BACKGROUND ART

A conventional art example will be described with reference to FIG. 4 and FIG. 5. FIG. 4 shows a conventional outer magnet type speaker. First magnetic circuit block 10 is made up of yoke 10A, first magnet 10B adhesive bonded to the center of the bottom face of the same, and plate 10C adhesive bonded to magnet 10B. Frame 20 is adhesive bonded on to the top face of plate 10C. The outer circumference of diaphragm 30 is joined to frame 20 via edge 40. The inner circumference of diaphragm 30 is adhesive bonded to voice coil member 50. Voice coil member 50 has coil portion 80. Coil portion 80 is located in the middle of magnetic gap 10D of first magnetic circuit block 10. Further, damper 60 is adhesive bonded to frame 20 and voice coil member 50. Thus, voice coil member 50 is supported for up-and-down movements. On the other hand, FIG. 5 shows a conventional inner magnet type speaker employing a repulsion magnetic circuit. By denoting corresponding parts to those in the speaker of FIG. 4 by like reference numerals, description of the same will be omitted. As shown in FIG. 5, the difference between them is that second magnetic circuit block 70 is provided on the top of first magnetic circuit block 10. Second magnetic circuit block 70 has a second magnet 70A, disposed to generate a magnetic field due to a magnetic flux repulsive to the direction of the magnetic flux from first magnet 10B, and sub-plate 70B. The magnetic flux density in magnetic gap 10D is enhanced by second magnetic circuit block 70. In the case of the speaker shown in FIG. 4, magnetization is not performed on first magnet 10B as a single part. After first magnetic circuit block 10 has been completed through adhesive bonding in an assembling process of a speaker, first magnetic circuit block 10 is magnetized (Magnetization). If first magnet 10B is magnetized prior to adhesive bonding of first magnet 10B with yoke 10A and plate 10C, there arises a problem as follows. First magnet 10B tends to attract yoke 10A and plate 10C each being a magnetic material. As a result, assembling work of first magnetic circuit block 10 becomes difficult. Therefore, first magnet 10B is magnetized after completion of the assembling of first magnetic circuit block 10 through adhesive bonding. On the other hand, a speaker having a repulsion magnetic circuit as shown in FIG. 5 is made up of first magnetic circuit block 10 and second magnetic circuit block 70. Directions of magnetic fields due to magnetic fluxes from first magnet 10B and second magnet 70A are opposite to each other. (That is, they repulse each other.) Therefore, it is impossible to magnetize the two magnetic circuit blocks after they have been adhesively bonded together. Hence, it becomes necessary to adhesively bond the two magnetic circuit blocks together after the first and second magnetic circuit blocks have been magnetized separately. As a result, the manufacturing method involving assembling of such two repulsive magnetic circuit blocks becomes difficult, time-consuming, and hence less productive. The present invention provides a manufacturing method of a repulsion magnetic circuit in which the above mentioned problem is overcome and also provides a manufacturing apparatus for use in the manufacturing method.

DISCLOSURE OF INVENTION

The invention provides a method of manufacturing a repulsion magnetic circuit, which has at least a first magnetic circuit block constituted of a yoke, a first magnet adhesive bonded to the yoke, and a plate adhesive bonded on to a top face of the first magnet and a second magnetic circuit block constituted of a second magnet adhesive bonded on to a top face of the plate such that its side and a side of the first magnet having identical polarity therewith confront each other, the method comprising the steps of: attaching the first magnetic circuit block constituted of the first magnet magnetized in advance to a lower jig; attaching the second magnetic circuit block constituted of the second magnet magnetized in advance to an upper jig;

applying an adhesive to at least one of faces to be bonded together of the first magnetic circuit block attached to the upper jig and the second magnetic circuit block attached to the upper jig; detecting coming into abutment of the first magnetic circuit block with the second magnetic circuit block when at least one of the first magnetic circuit block attached to the lower jig and the second magnetic circuit block attached to the upper jig is shifted toward the other; and applying a predetermined pressing force.

It further provides an apparatus for use in the manufacturing method.

DETAILED DESCRIPTION OF PREFERRED EMBODIMENT

Figure 2:
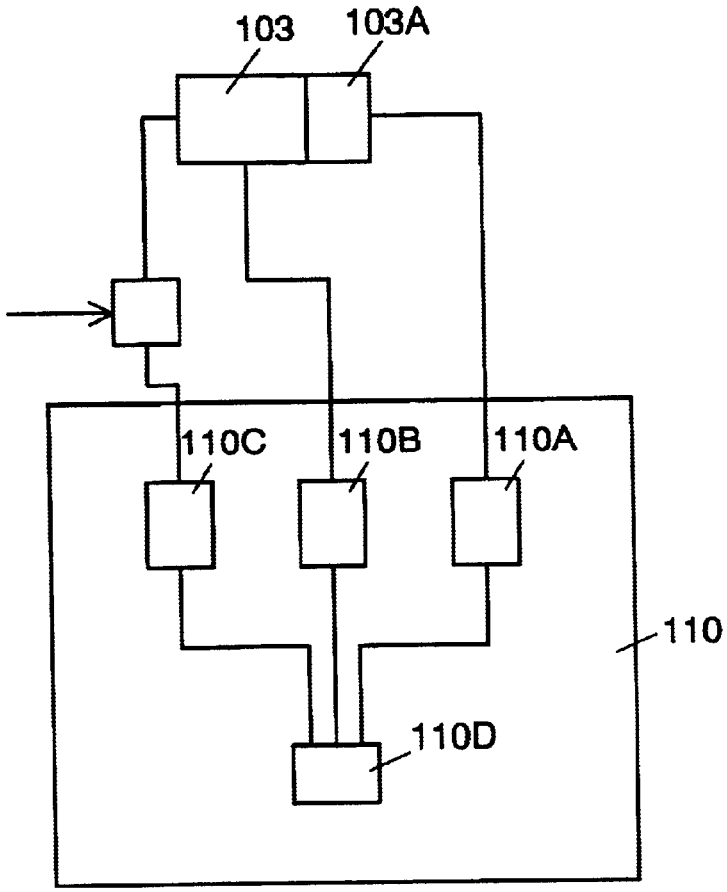
FIG. 2 is a circuit block diagram of a controller of the manufacturing apparatus according to an embodiment of the invention.
Figure 3:
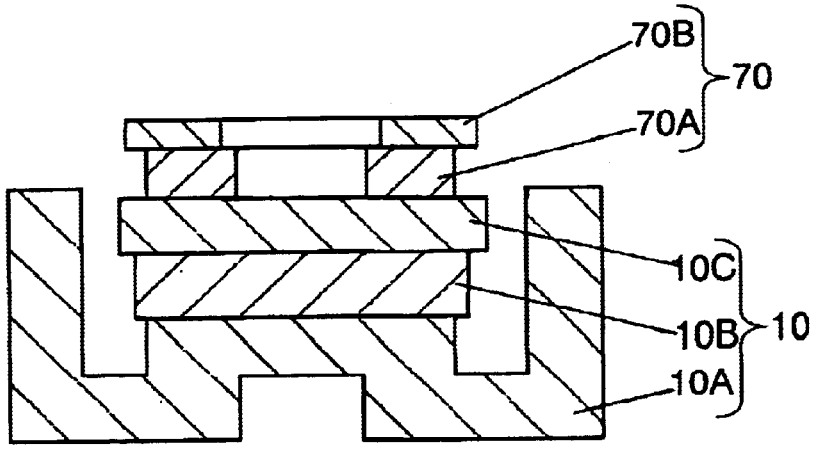
FIG. 3 is a sectional view of a magnetic circuit block according to an embodiment of the invention.
Figure 4:
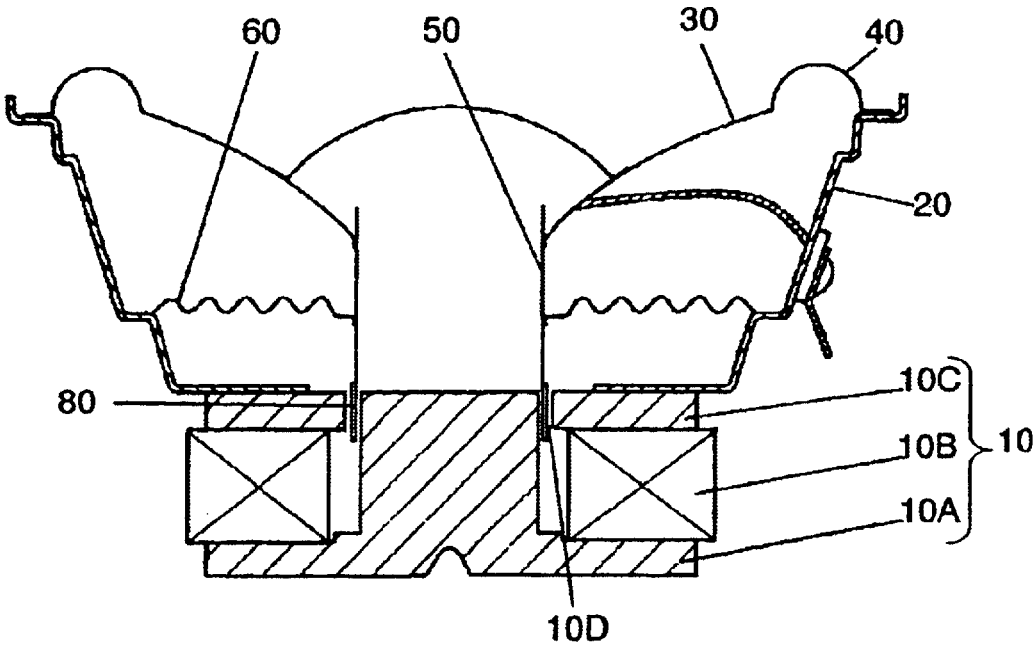
FIG. 4 PRIOR ART
FIG. 4 is a sectional view of a speaker employing a conventional outer magnet type magnetic circuit.
Figure 5:
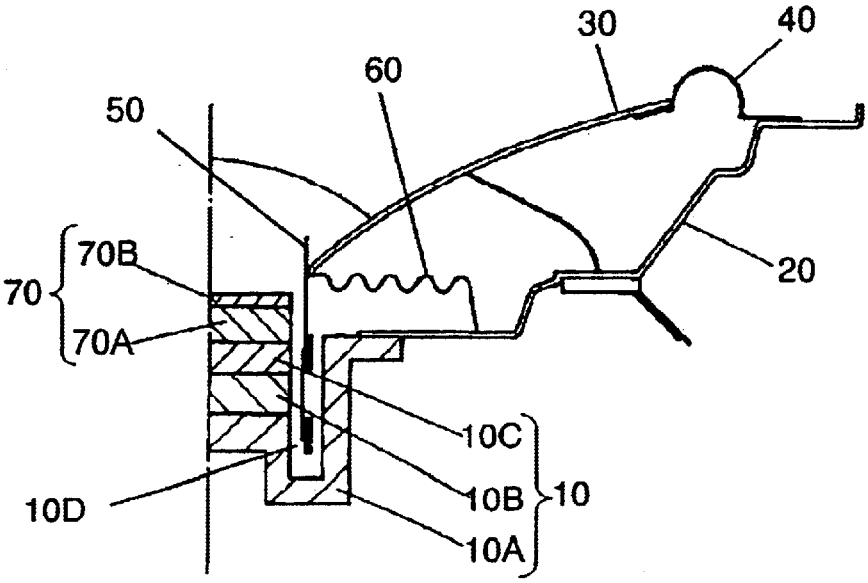
FIG. 5 PRIOR ART
FIG. 5 is a sectional view of one half of a speaker employing a conventional repulsion magnetic circuit.

An embodiment of the present invention will be described below with reference to FIG. 1 to FIG. 3. Like parts to those in the speaker employing a repulsion magnetic circuit shown in FIG. 5 are denoted by like reference numerals. Incidentally, the drawings are just schematic diagrams and not such that indicate each position in an exact size.

(Exemplary Embodiment)

Figure 1:
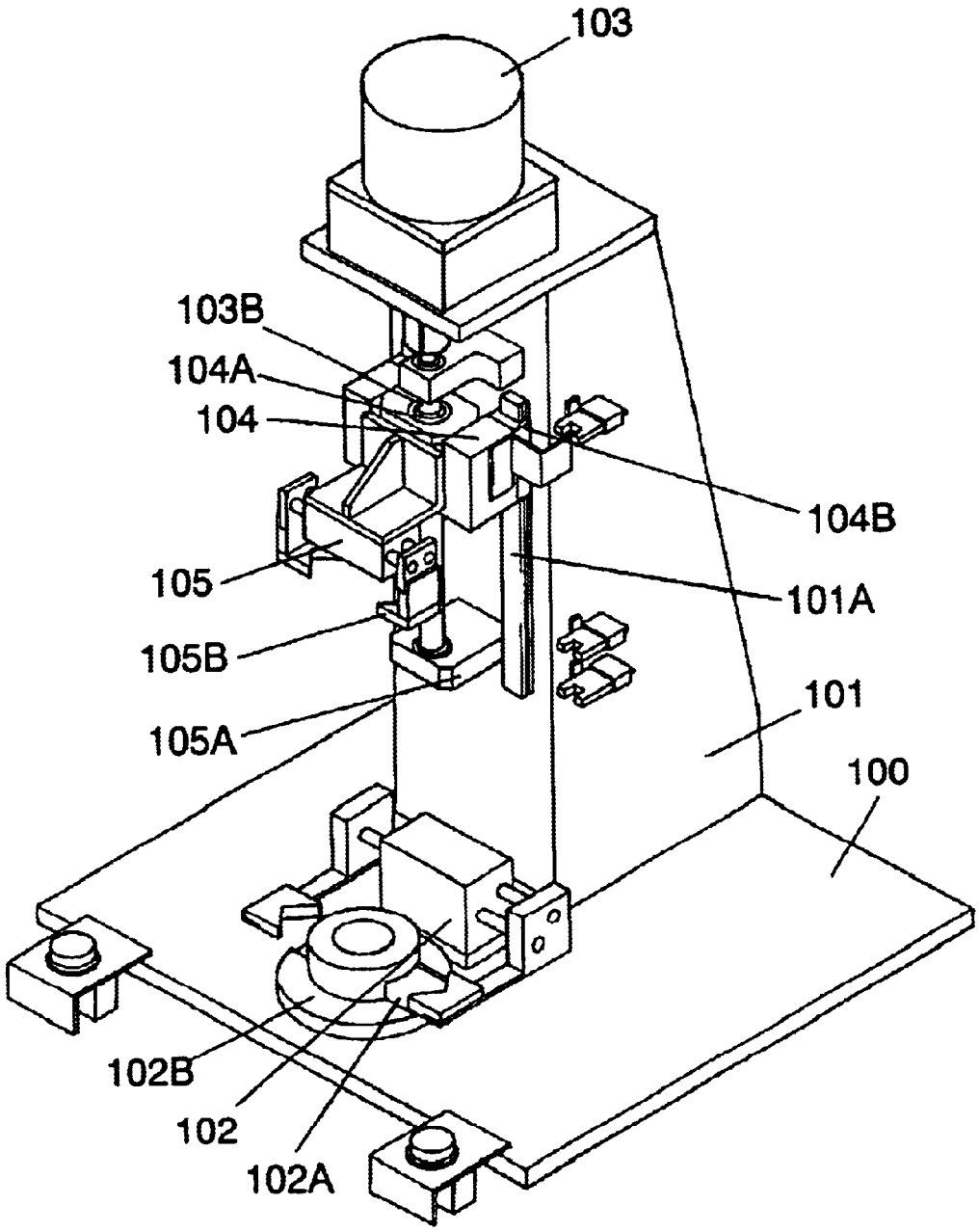
FIG. 1 is a perspective view of a manufacturing apparatus according to a first embodiment of the present invention.

As shown in FIG. 1, base plate 100 has pole 101.

Lower jig 102 has lower chuck portion 102A and center guide 102B for attaching thereto first magnetic circuit block 10 which has been magnetized. Servomotor 103 as an electric motor, controlled by a controller (not shown), is fixed on to the top of pole 101.

Slider 104 has upper jig 105 mounted thereon. Slider 104 is formed of screw portion 104A and rotation controlling portion 104B. Screw portion 104A is meshed with ball screw 103B mounted on the revolving shaft of servomotor 103. Thereby, rotating movements of servomotor 103 are converted into linear up-and-down movements. For controlling the rotation of slider 104 following the rotation of servomotor 103, rotation controlling portion 104B is arranged astride and slidable along linear guide 101A provided on pole 101. Second magnetic circuit block 70 which has been magnetized is attached to upper jig 105. Upper jig 105 is formed of supporting portion 105A arranged to slide along pole 101 for preventing deflections at the free end side of the upper jig and upper chuck portion 105B for use in setting up second magnetic circuit block 70. Referring to FIG. 2, a controlling function will be described below. Controller 110 is connected with encoder 103A of an incremental type incorporated in servomotor 103. It further has an output terminal connected to the input terminal of servomotor 103. Controller 110 is formed of position detecting unit 110A, load current detecting unit 110B, current supplying unit 110C, and instructing unit 110D. Upon receipt of a pulse signal from encoder 103A, position detecting unit 110A detects the position of the slider having upper jig 105 mounted thereon, via servomotor 103. Load current detecting unit 110B detects the load current of servomotor 103. Current supplying unit 110C supplies power to servomotor 103. Instructing unit 110D receives respective signals from position detecting unit 110A and load current detecting unit 110B. The same, on the basis of the signals, issues current supplying unit 110C an instruction to supply the load current.

Operation of the manufacturing apparatus of a repulsion magnetic circuit configured as above will be described. First, when slider 104 is at an upper stopping position, second magnetic circuit block 70 is attached to upper jig 105.

Then, first magnetic circuit block 10 is attached to lower jig 102. (Step of attachment of magnetic circuit blocks 10 and 70.)

At this time, at least one of abutting faces between magnetic circuit blocks 10 and 70 is applied with an adhesive. (Step of applying adhesive.)

Then, a driving command is given to instructing unit 110D of controller 110 by manual entry. Thereupon, slider 104 descends at a high speed in accordance with rotations of servomotor 103 to a predetermined position. Upon arriving at the predetermined position, slider 104 descends at a low speed. (Position detecting unit 110A measures pulses from encoder 103A to detect position. Meanwhile, servomotor 103 is controlled by controller 110.)

Since the load current rises when magnetic circuit block 10 is brought into abutment with magnetic circuit block 70, load current detecting unit 110B detects it as the point of abutment (step of detection of abutment). Then, instructing unit 110D, taking the point of abutment as the starting point, starts counting the number of pulses output from encoder 103. (Relationship between the force for pressing magnetic circuit blocks 10 and 70 together and pressing time depending on the number of pulse counts is quantitatively obtained in advance.) After a predetermined number of pulses have been counted (after a predetermined pressing time has passed under application of a predetermined pressing force), an instruction is issued to release the attachment of magnetic circuit block 10 to upper jig 105. At the same time, an instruction to ascend slider 104 to the upper stopping position at a high speed is issued to servomotor 103 via current supplying unit 110C. (Pressing step.) Thus, a magnetic circuit block as shown in FIG. 3 can be manufactured. By repeating the steps as described above, manufacturing of repulsion magnetic circuits can be performed continuously.

By automating the steps of attachment and detachment of magnetic circuit block 10 and magnetic circuit block 70, assembling man-hours can further be reduced. With the present embodiment, as described above, slider 104 descends at a low speed during a predetermined number of counts. As a result, the pressing force on magnetic circuit block 10 and magnetic circuit block 70 and the pressing time are controlled so that adhesive bonding can be performed stably and efficiently. More specifically, the of abutment between magnetic circuit block 10 and magnetic circuit block 70 is detected by an increase in the load current by load current detecting unit 110B. As a result, the point of abutment can be determined without consideration of manufacturing variations in the thickness direction. Thereafter, by counting the number of pulses from encoder 103, the pressing force and the pressing time can be determined so that adhesive bonding between magnetic circuit block 10 and magnetic circuit block 70, that are repulsive from each other, can be attained. Thus, adhesive bonding between magnetic circuit block 10 and magnetic circuit block 70 repulsive from each other can be attained not by using a press mechanism utilizing air pressure or oil pressure as with conventional cases, but by means of a mechanical drive. As a result, a speedup in productivity can be attained. Although, in the above embodiment, second magnetic circuit block 70 has been described to be made up of sub-plate 70B and second magnet 70A, it may be formed only of second magnet 70A. Although, in the present embodiment, only the upper jig has been moved up-and-down, only the lower jig may be moved up-and-down. Or, it may be configured such that both the upper and lower jigs are moved up-and-down. As the magnet, any of such various magnets as ferrite magnet, samarium-cobalt magnet, and neodymium magnet can be used. Although, the present embodiment has been described above with an inner magnet type repulsion magnetic circuit taken as an example, it can also be applied to an outer magnet type repulsion magnetic circuit. As the adhesive used in the present invention, known materials used in the manufacture of conventional speakers such as adhesives of acrylic resin type and rubber-base, for example, may be used.

INDUSTRIAL APPLICABILITY

The method of manufacturing a repulsion magnetic circuit of the present invention is configured to press magnetic circuit block 10 and magnetic circuit block 70 together for a predetermined time after an abutment between them has been detected. Therefore, a stable repulsion magnetic circuit can be provided with increased production efficiency.

Reference Numeral in the Drawings

10 First magnetic block circuit
10A Yoke
10B First magnet
10C Plate
10D Magnetic gap
20 Frame
30 Diaphragm
40 Edge
50 Voice coil member
60 Damper
70 Second magnetic circuit block
70A Second magnet
70B Sub-plate
80 Coil portion
100 Base plate
101 Pole
101A Guide
102 Lower jig
102A Lower chuck portion
102B Center guide
103 Servomotor

103A Encoder
103B Ball screw
104 Slider
104A Screw portion
104B Rotation controlling portion
105 Upper jig
105A Supporting portion
105B Upper chuck portion
110 Controller
110A Position detecting unit
110B Load current detecting unit
110C Current supplying unit
110D Instructing unit

What is claimed is:

1. A method of manufacturing a repulsion magnetic circuit, which has at least a first magnetic circuit block constituted of a yoke, a first magnet adhesive bonded to the yoke, and a plate adhesive bonded on to a top face of the first magnet and a second magnetic circuit block constituted of a second magnet adhesive bonded on to a top face of the plate such that its side and a side of the first magnet having identical polarity therewith confront each other, the method comprising the steps of:

attaching the first magnetic circuit block constituted of the first magnet magnetized in advance to a lower jig;

attaching the second magnetic circuit block constituted of the second magnet magnetized in advance to an upper jig;

applying an adhesive to at least one of faces to be bonded together of the first magnetic circuit block attached to the lower jig and the second magnetic circuit block attached to the upper jig;

detecting coming into abutment of the first magnetic circuit block with the second magnetic circuit block when at least one of the first magnetic circuit block attached to the lower jig and the second magnetic circuit block attached to the upper jig is shifted toward the other; and applying a predetermined pressing force.

2. The method of manufacturing a repulsion magnetic circuit according to claim 1, wherein the step of applying a predetermined pressing force is attained by converting a rotating movement of an electric motor into a linear movement.

3. The method of manufacturing a repulsion magnetic circuit according to claim 1, wherein the step of detecting the coming into abutment is attained by detection of an increase in a load current of an electric motor.

4. An apparatus for manufacturing a repulsion magnetic circuit comprising:

a lower jig for attaching a first magnetic circuit block thereto;

an upper jig spaced apart from the lower jig and movable up-and-down for attaching a second magnetic circuit block thereto;

a screw portion provided on the upper jig in mesh with a ball screw such that rotating movements of the ball screw are converted into up-and-down movements of the upper jig;

an electric motor for rotating the ball screw in left-and-right directions; and a controller for giving the electric motor instructions to descend the upper jig for detecting an abutment between the first magnetic circuit block and the second magnetic circuit block, then to keep pressing for attaining adhesive bonding therebetween, and, after a predetermined time of pressing, to reverse rotation of the electric motor for ascending the upper jig to return to its original position.

5. The manufacturing apparatus of a repulsion magnetic circuit according to claim 4, wherein the electric motor is a servomotor.

6. The manufacturing apparatus of a repulsion magnetic circuit according to claim 5, wherein the predetermined time of pressing is determined based on number of pulses from an encoder coupled with the servomotor.

* * * * *